US009378707B2

(12) United States Patent
Lee

(10) Patent No.: US 9,378,707 B2
(45) Date of Patent: Jun. 28, 2016

(54) GAMMA VOLTAGE GENERATION UNIT AND DISPLAY DEVICE USING THE SAME

(71) Applicant: LG DISPLAY CO., LTD., Seoul (KR)

(72) Inventor: Hyun Jae Lee, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/024,971

(22) Filed: Sep. 12, 2013

(65) Prior Publication Data

US 2014/0184657 A1 Jul. 3, 2014

(30) Foreign Application Priority Data

Dec. 27, 2012 (KR) ..... 10-2012-0155443

(51) Int. Cl.
*G09G 5/10* (2006.01)
*G09G 3/32* (2016.01)
*G09G 3/36* (2006.01)

(52) U.S. Cl.
CPC ..... *G09G 5/10* (2013.01); *G09G 3/3208* (2013.01); *G09G 3/3696* (2013.01); *G09G 2320/0673* (2013.01); *G09G 2330/028* (2013.01); *G09G 2360/144* (2013.01)

(58) Field of Classification Search
CPC ..... G09G 3/30; G09G 3/36; G09G 5/10; G09G 5/00; G09G 3/3208; G09G 3/3696; G09G 2320/0673; G09G 2330/028; G09G 2360/144; H04W 88/02; G06F 3/038
USPC ..... 345/77, 89, 98, 100, 690
See application file for complete search history.

(56) References Cited

U.S. PATENT DOCUMENTS 6,275,207 B1 * 8/2001 Nitta et al. ..... 345/89
8,305,370 B2 11/2012 Song et al.
8,860,767 B2 10/2014 Yu et al.
8,970,460 B2 3/2015 Yaguma et al.

(Continued)

FOREIGN PATENT DOCUMENTS

CN 1848213 A 10/2006
CN 101393730 A 3/2009

(Continued)

OTHER PUBLICATIONS

"Understanding Digitally Programmable Potentiometers", Aug. 16, 2011, XP055131649, Retrieved from the Internet: URL:http://www.onsemi.com/pub_link/Collate ral/TND6010-D.PDF.

*Primary Examiner* — Lun-Yi Lao
*Assistant Examiner* — Johny Lau
(74) *Attorney, Agent, or Firm* — Birch, Stewart, Kolasch & Birch, LLP

(57) ABSTRACT

A gamma voltage generation unit is discussed which includes: a voltage booster to boost a first maximum reference voltage into at least one second maximum reference voltage; a mode selector configured to select one of the maximum reference voltage and the at least one second maximum reference voltage as a selected maximum reference voltage; and a plurality of gamma voltage adjusters. The selected maximum reference voltage selected by the mode selector is provided as a 255th gray-scale gamma voltage. A first gamma voltage adjuster among the gamma voltage adjusters can generate the 255th gray-scale gamma voltage and another gray-scale gamma voltage based on the selected maximum reference voltage. The remaining gamma voltage adjusters are connected to one another in a cascade.

16 Claims, 6 Drawing Sheets

(56) References Cited

U.S. PATENT DOCUMENTS

| | | | | |
|---|---|---|---|---|
| 2006/0227082 | A1* | 10/2006 | Ogata | G09G 3/3291 345/76 |
| 2007/0002188 | A1 | 1/2007 | Kumagai et al. | |
| 2008/0198118 | A1 | 8/2008 | Choi | |
| 2008/0204378 | A1 | 8/2008 | Park et al. | |
| 2008/0291190 | A1 | 11/2008 | Kim et al. | |
| 2010/0026679 | A1 | 2/2010 | Fujiwara | |
| 2010/0066766 | A1* | 3/2010 | Mancuso et al. | 345/690 |
| 2010/0120471 | A1* | 5/2010 | Uchikawa et al. | 455/566 |
| 2010/0225678 | A1 | 9/2010 | Kim et al. | |
| 2011/0084954 | A1* | 4/2011 | Lee et al. | 345/212 |
| 2011/0141089 | A1* | 6/2011 | Lee | 345/211 |
| 2011/0141098 | A1* | 6/2011 | Yaguma | G09G 3/3688 345/212 |
| 2013/0249955 | A1* | 9/2013 | Kim | G09G 3/3233 345/690 |

FOREIGN PATENT DOCUMENTS

| | | | |
|---|---|---|---|
| CN | 101640479 | A | 2/2010 |
| CN | 102106080 | A | 6/2011 |
| JP | 2008-209882 | A | 9/2008 |
| JP | 2009-145492 | A | 7/2009 |
| JP | 2010-20299 | A | 1/2010 |
| KR | 10-2003-0004552 | A | 1/2003 |

* cited by examiner

Fig. 6

| D7 | D6 | D5 | D4 | D3 | D2 | D1 | D0 | Function | Note |
|---|---|---|---|---|---|---|---|---|---|
| 0 | 0 | 0 | 0 | 0 | 0 | 0 | 0 | Off | |
| 0 | 0 | 0 | 1 | X | X | X | X | Level 1 | |
| 0 | 0 | 1 | 0 | X | X | X | X | Level 1 | |
| 0 | 0 | 1 | 1 | X | X | X | X | Level 1 | |
| 0 | 1 | 0 | 0 | X | X | X | X | Level 1 | |
| 0 | 1 | 0 | 1 | X | X | X | X | Level 1 | |
| 0 | 1 | 1 | 0 | X | X | X | X | Level 1 | |
| 0 | 1 | 1 | 1 | X | X | X | X | Level 1 | |
| 1 | 0 | 0 | 0 | X | X | X | X | Level 1 | |
| 1 | 1 | 1 | 1 | X | X | X | X | Auto Detection | ALS Command and use |

Fig. 7

| LEVEL | LIGHT QUANTITY (HIGH BOUNDARY VALUE) | S_BOOST | | | | | | | | DECIMAL VALUE |
|---|---|---|---|---|---|---|---|---|---|---|
| | | D7 | D6 | D5 | D4 | D3 | D2 | D1 | D0 | |
| LEVEL8 | 100 | 0 | 0 | 1 | 0 | 1 | 0 | 0 | 0 | 40 |
| LEVEL7 | 90 | 0 | 0 | 1 | 0 | 0 | 0 | 1 | 1 | 35 |
| LEVEL6 | 80 | 0 | 0 | 0 | 1 | 1 | 1 | 1 | 0 | 30 |
| LEVEL5 | 70 | 0 | 0 | 0 | 1 | 1 | 0 | 0 | 1 | 25 |
| LEVEL4 | 60 | 0 | 0 | 0 | 1 | 0 | 1 | 0 | 0 | 20 |
| LEVEL3 | 50 | 0 | 0 | 0 | 0 | 1 | 1 | 1 | 1 | 15 |
| LEVEL2 | 40 | 0 | 0 | 0 | 0 | 1 | 0 | 1 | 0 | 10 |
| LEVEL1 | 30 | 0 | 0 | 0 | 0 | 0 | 1 | 0 | 1 | 5 |
| Off | 20 | 0 | 0 | 0 | 0 | 0 | 0 | 0 | 0 | 0 |

Fig. 8

| E3 H | SET_ALS_READOUT | | | | | | | | | |
|---|---|---|---|---|---|---|---|---|---|---|
| | Write/Read | D7 | D6 | D5 | D4 | D3 | D2 | D1 | D0 | HEX |
| Command | Write | 0 | 0 | 1 | 0 | 0 | 0 | 0 | 0 | E3 |
| Parameter 1 | Write | ALS 31 | ALS 30 | ALS 29 | ALS 28 | ALS 27 | ALS 26 | ALS 25 | ALS 24 | |
| Parameter 2 | Write | ALS 23 | ALS 22 | ALS 21 | ALS 20 | ALS 19 | ALS 18 | ALS 17 | ALS 16 | |
| Parameter 3 | Write | ALS 15 | ALS 14 | ALS 13 | ALS 12 | ALS 11 | ALS 10 | ALS 9 | ALS 8 | |
| Parameter 4 | Write | ALS 7 | ALS 6 | ALS 5 | ALS 4 | ALS 3 | ALS 2 | ALS 1 | ALS 0 | |

GAMMA VOLTAGE GENERATION UNIT AND DISPLAY DEVICE USING THE SAME

This application claims the benefit and priority under 35 U.S.C. §119(a) of Korean Patent Application No. 10-2012-0155443 filed on Dec. 27, 2012, which is hereby incorporated by reference in its entirety.

BACKGROUND OF THE INVENTION

1. Field of the Invention

The embodiments of the invention relate to a gamma voltage generation unit. Also, the embodiments of the invention relate to a display device.

2. Description of the Related Art

Flat display devices with features of slimness, lighter weight, lower power consumption and so on are being actively researched, developed or mass-produced. The flat display devices include liquid crystal display (LCD) devices, plasma display devices, field emission display devices, organic light-emitting display (OLED) devices or others.

Among the flat display devices, the LCD devices are being applied to mobile terminals, navigation devices, cameras, camcorders or others which have small sized screens. Also, the LCD devices are being applied to netbooks, notebook computers or others which have middle sized screens. Moreover, the LCD devices are being applied to television receivers, electric display board and so on which have large sized screens.

In particular, many special functions are added to the mobile terminal. As such, the mobile terminal becomes a necessity, for which modern society cannot do without. Actually, the mobile terminal can allow a user to retrieve, input, check and transmit information regardless of time, place, weather and so on. In other words, the mobile terminal is always being used by the user regardless of place, which includes the interior and the exterior, and time, which includes day and night.

However, visibility of the mobile terminal must be varied for the interior or the exterior, and for day or night, even though the information is displayed on the display device of the mobile terminal in the same brightness. In particular, visibility of the display device of the mobile terminal deteriorates in cloudy weather, a dark evening and so on.

To address this matter, a method of adjusting brightness on the basis of light intensity from a photo sensor is disclosed in Korean registered patent no. KR10-0418889 (hereinafter, 'prior document 1').

The prior art method disclosed in the prior document 1 increases the output value of a digital data signal in order to enhance visibility. In detail, a low data signal is modulated into a lower value than its value, and a high data signal is modulated into a higher value than its value. As such, the modulated low and high data signals cannot provide the attributions of original data signals. Furthermore, the data can be lost. Due to this, image distortion or/and non-desired faults can be caused.

Such a data modulation for enhancing visibility can be performed according to previously set three modes. Because the data modulation is limited to the three modes, it is difficult to increase brightness beyond a critical value. When the number of modes increases, the size of code used to set the increased modes must be enlarged.

Meanwhile, if an LCD device is used as a display device of the mobile terminal, visibility can be enhanced by adjusting brightness of a backlight unit. In this instance, black brightness for a black level can also increase. Due to this, a contrast ratio must become lower.

SUMMARY OF THE INVENTION

Accordingly, embodiments of the invention are directed to a display device that substantially obviates one or more of problems due to the limitations and disadvantages of the related art.

The embodiments of the invention are to provide a display device that is adapted to prevent data loss or/and image distortion using a gamma modulation instead of a data modulation.

The embodiments of the invention are to provide a display device that is adapted to a display device that is adapted to prevent deterioration of contrast ratio by performing a gamma modulation for a high gray scale range.

The embodiments of the invention are to provide a display device that is adapted to simplify the configuration by minimizing additional components.

Additional features and advantages of the embodiments of the invention will be set forth in the description which follows, and in part will be apparent from the description, or may be learned by practice of the embodiments of the invention. The advantages of the embodiments of the invention will be realized and attained by the structure particularly pointed out in the written description and claims hereof as well as the appended drawings.

According to a first general aspect of the embodiment of the invention, a gamma voltage generation unit includes: a voltage booster configured to boost a first maximum reference voltage into at least one second maximum reference voltage; a mode selector configured to select one of the maximum reference voltage and the at least one second maximum reference voltage as a selected maximum reference voltage; and a plurality of gamma voltage adjusters. The selected maximum reference voltage selected by the mode selector is provided as a 255th gray-scale gamma voltage. A first gamma voltage adjuster among the plurality of gamma voltage adjusters can generate the 255th gray-scale gamma voltage and another gray-scale gamma voltage based on the selected maximum reference voltage. The remaining gamma voltage adjusters are connected to one another in a cascade and generate gray-scale gamma voltages between the $255^{th}$ gray-scale gamma voltages and the another gray-scale gamma voltage.

A display device according to a second general aspect of the embodiment of the invention includes: a gamma voltage generation unit configured to adjust gamma voltages; a light quantity detector configured to detect a light quantity; and a gamma control unit configured to generate first through third gamma control signals in accordance with the detected light quantity and apply the first through third gamma control signals to the gamma voltage generation unit.

Other systems, methods, features and advantages will be, or will become, apparent to one with skill in the art upon examination of the following figures and detailed description. It is intended that all such additional systems, methods, features and advantages be included within this description, be within the scope of the embodiments of the invention, and be protected by the following claims. Nothing in this section should be taken as a limitation on those claims. Further aspects and advantages are discussed below in conjunction with the embodiments of the invention. It is to be understood that both the foregoing general description and the following detailed description of the embodiments of the invention are by example and are intended to provide further explanation of the invention as claimed.

BRIEF DESCRIPTION OF THE DRAWINGS

The accompanying drawings, which are included to provide a further understanding of the embodiments of the invention and are incorporated herein and constitute a part of this application, illustrate embodiment(s) of the invention and together with the description serve to explain the invention. In the drawings:

FIG. 6 is a data sheet illustrating a first register of FIG. 3 according to an embodiment of the invention;

FIG. 7 is a data sheet illustrating a second register of FIG. 3 according to an embodiment of the invention;

FIG. 8 is a data sheet illustrating a third register of FIG. 3 according to an embodiment of the invention;

DETAILED DESCRIPTION OF THE EMBODIMENTS

Figure 1:
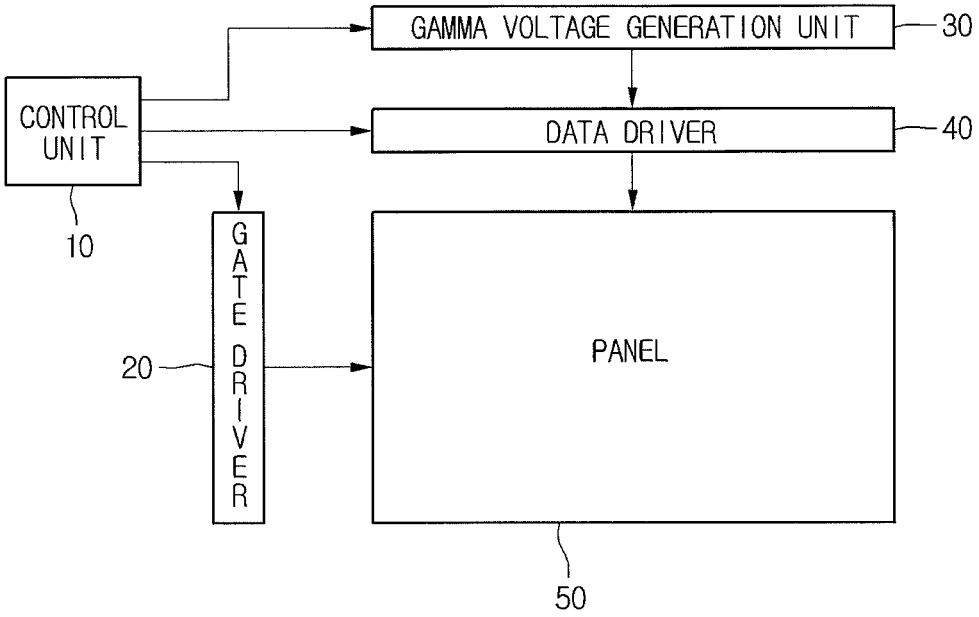
FIG. 1 is a block diagram showing a display device according to an embodiment of the invention.

In the embodiments of the invention, it will be understood that when an element, such as a substrate, a layer, a region, a film, or an electrode, is referred to as being formed "on" or "under" another element in the embodiments of the invention, it may be directly on or under the other element, or intervening elements (indirectly) may be present. The term "on" or "under" of an element will be determined based on the drawings. Reference will now be made in detail to the embodiments of the invention, examples of which are illustrated in the accompanying drawings. In the drawings, the sizes and thicknesses of elements can be exaggerated, omitted or simplified for clarity and convenience of explanation, but they do not necessarily refer to the practical sizes of the elements.

FIG. 1 is a block diagram showing a display device according to an embodiment of the invention.

The display device according to an embodiment of the invention can be one of an LCD device and an OLED device. However, the embodiment of the invention is not limited to this.

For convenience of explanation, the OLED device will now be described as an example of the embodiment of the invention.

Referring to FIG. 1, the display device according to an embodiment of the invention can include a control unit 10, a gamma voltage generation unit 30, a gate driver 20, a data driver 40 and a panel 50.

The control unit 10 can control to display an image (e.g., via data) on the panel 50, but it is not limited to this.

If the display device is applied to a mobile terminal, the control unit 10 may be a main board, but it is not limited to this. In this instance, the control unit 10 can include entirely controlling components equipped in the mobile terminal.

The control unit 10 can control the gamma voltage generation unit 30, the gate driver 20 and the data driver 40 which need to drive the panel 50. However, the control unit 10 is not limited to this.

The gate driver 20 can generate gate signals under the control of the control unit 10. The gate signals can be applied from the gate driver 20 to the panel 50.

The gamma voltage generation unit 30 can generate gamma voltages under the control of the control unit 10. The gamma voltages can be applied from the gamma voltage generation unit 30 to the data driver 40.

The gamma voltage generation unit 30 can adjust the gamma voltages of a partial range under the control of the control unit 10, as a first example. However, the embodiment of the invention is not limited to this. For example, the gamma voltages of the partial range can include 0th through 127th gray-scale gamma voltages.

As a second example, the gamma voltage generation unit 30 can adjust the gamma voltages of the entire range under the control of the control unit 10. However, the embodiment of the invention is not limited to this. The gamma voltages of the entire range can include 0th through 255th gray-scale gamma voltages.

Furthermore, the embodiment of the invention can be implemented in an integrated manner of the first and second examples.

The data driver 40 can generate data voltages under the control of the control unit 10. The data voltages can be applied from the data driver 40 to the panel 50.

The data voltage can become one of the gamma voltages, which are applied from the gamma voltage generation unit 30, on the basis of a digital control signal which is applied from the control unit 10. However, the data voltage is not limited to this.

The panel 50 can be an OLED panel. Such a panel 50 can display an image based on the gate signals applied from the gate driver 20 and the data voltages applied from the data driver 40.

In order to display the images on the OLED panel, power supply voltages and control signals used to control a plurality of transistors can be required as well except the gate signals and the data voltages. However, the embodiment of the invention is not limited to this.

The OLED panel can include a plurality of pixels which are arranged in a matrix shape. The pixels can each include a switching element, a driving element, a storage capacitor, a plurality of switches and an organic light emission diode.

The switching element can be a transistor used to select the respective pixel. The driving element can be another transistor used to generate a driving current which is applied to the organic light emission diode. The plurality of switches can be used to prevent a driving error or/and leakage of the driving current in the pixel or/and enhance brightness. However, the plurality of switches are not limited to this.

Subsequently, the control unit and the gamma voltage generation unit 30 will be described in detail.

Figure 2:
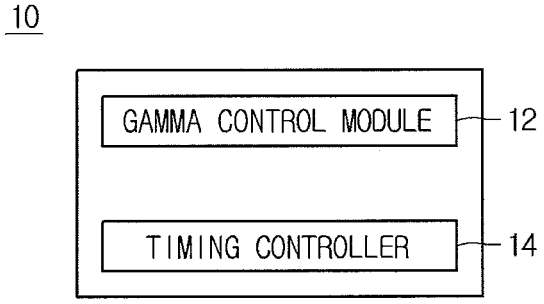
FIG. 2 is a detailed block diagram showing a control unit of FIG. 1 according to an embodiment of the invention.
Figure 3:
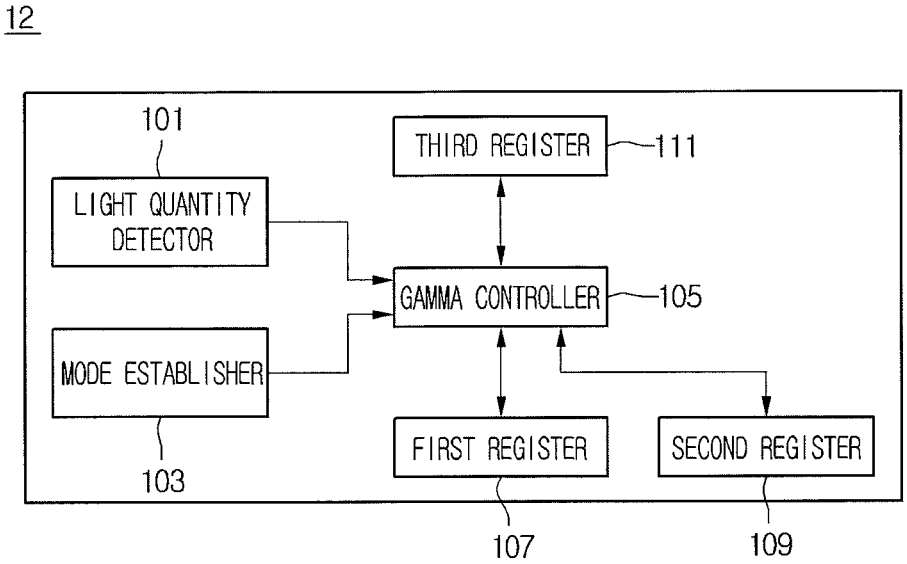
FIG. 3 is a detailed block diagram showing a gamma control module of FIG. 2 according to an embodiment of the invention.

FIG. 2 is a detailed block diagram showing a control unit of FIG. 1. FIG. 3 is a detailed block diagram showing a gamma control module of FIG. 2.

The control unit 10 can include a timing controller 14 and a gamma control module 12.

The timing controller 14 can generate control signals used to control the gate driver 20 and the data driver 40. In detail, the timing controller 14 can generate gate control signals and data control signals. The gate control signals can be used to control the gate driver 20, and the data control signals can be used to control the data driver 40.

The control unit 10 can receive a vertical synchronous signal Vsync, a horizontal synchronous signal Hsync, a data enable signal DE and a data clock signal Dclk from one of an external hard disk, an image storage device and so on. Also, the control unit 10 can receive red, green and blue (hereinafter, 'RGB') data signals from one of an external hard disk, an image storage device and so on.

The RGB data signals can be re-arranged. The re-arranged RGB data signals can be applied from the control unit 10 to the data driver 40.

The vertical synchronous signal Vsync, the horizontal synchronous signal Hsync, the data enable signal DE and the data clock signal Dclk can be applied to the timing controller 14.

The timing controller 14 can derive the gate control signals and the data control signals from the vertical synchronous signal Vsync, the horizontal synchronous signal Hsync, the data enable signal DE and the data clock signal Dclk.

The gamma control module 12 can control the gamma voltage generation unit 30 to adjust the gamma voltages, but it is not limited to this.

Also, the gamma control module 12 can generate a plurality of control signals used to control the gamma voltage generation unit 30, but it is not limited to this. The plurality of control signals generated in the gamma control module 12 can be applied to the gamma voltage generation unit 30.

The gamma voltage generation unit 30 can adjust the gamma voltages according to an external light quantity. Alternatively, the gamma voltage generation unit 30 can adjust the gamma voltages according to a given reference regardless of the external light quantity. However, the gamma voltage generation unit 30 is not limited to these.

The gamma control module 12 can selectively set three modes, in order to enable the gamma voltages to be adjusted by the gamma voltage generation unit 30. However, the gamma control module 12 is not limited to this.

For example, the gamma control module 12 can perform a gamma control according to one of a normal mode, a boost mode and an automatic mode. However, the gamma control module 12 is not limited to this. As shown in FIG. 3, the gamma control module 12 can include a light quantity detector 101, a mode establisher 103, a gamma controller 105 and first through third registers 107, 109 and 111.

The light quantity detector 101 can detect an external light quantity on the basis of a sensing signal which is applied from the illumination sensor. If the display device is applied to the mobile terminal, the illumination sensor can be mounted to a region of an outer surface of the mobile terminal. As such, the light quantity detector 101 can detect the external light quantity using the illumination sensor.

The mode establisher 103 can serve a function of setting one of the normal, boost and automatic modes, as described above.

The mode setting operation can proceed in response to a user's command.

As an example, if the user depresses one time a fixed button or touches one time a screen, the mode establisher 103 can set the gamma control mode into the normal mode in response to a command which is generated by the single depressing or touching action. The normal mode forces the gamma voltages to be not adjusted. As such, the gamma voltages of the normal mode can be used as they are.

As another example, when the user depresses two times the fixed button or touches two times the screen, the mode establisher 103 can set the gamma control mode into the boost mode in response to another command which is generated by the double depressing or touching action. The boost mode can enable the gamma voltages to be adjusted according to the external light quantity.

As still another example, if the user depresses three times the fixed button or touches three times the screen, the mode establisher 103 can set the gamma control mode into the automatic mode in response to still another command which is generated by the triple depressing or touching action. The automatic mode can allow the gamma voltages to be automatically adjusted according to the external light quantity.

The depressing or touching action for the button or screen is described as an embodiment. However, the embodiment of the invention is not limited to this. For example, the number of times for the depressing or touching action may be differently set.

The mode establisher 103 can perform the mode setting operation under the control of the gamma controller 105. In detail, the user's command can be applied to the gamma controller 105. The gamma controller 105 can refer to the first register 107 on the basis of the user's command and retrieve a parameter from an address of the first register 107 corresponding to the user's command. Also, the gamma controller 105 can control the mode establisher 103 to set a gamma control mode corresponding to the retrieved parameter. However, the embodiment of the invention is not limited to the above-mentioned mode setting process.

As shown in FIG. 6, the parameters can be stored in the first register 107 according to the addresses including first through tenth addresses. For example, a first parameter of '00000000' can be stored in a region of the first register 107 opposite to the first address, a second parameter of '0001XXXX' can be stored in another region of the first register 107 opposite to the second address, and a third parameter of '0010XXXX' can be stored in still another region of the first register 107 opposite to the third address. The other mode parameters including fourth through tenth parameters can be stored in regions of the first register 107 opposite to the other addresses including the fourth through tenth addresses.

The first parameter opposite to the first address can be a control command regarding the normal mode. The second through ninth parameters each opposite to the second through ninth addresses can be control commands regarding the boost mode. The tenth parameter opposite to the tenth address can be a control command regarding the automatic mode.

For example, if the user's command corresponds to the normal mode, the gamma controller 105 can read the first parameter from the first address of the first register 107. Also, the gamma controller 105 can control the mode establisher 103 to set the normal mode corresponding to the first parameter.

The gamma controller 105 can generate gamma control signals on the basis of the gamma control mode, which is set by the mode establisher 103, and the light quantity detected by the light quantity detector 101. The gamma control signals can be applied from the gamma controller 105 to the gamma voltage generation unit 30.

The gamma controller 105 can generate first through third gamma control signals.

For example, the first gamma control signal can be a first selection signal BOOST used to select whether a 255th gray-scale gamma voltage V255 is generated in the normal mode or the boost mode. However, the first gamma control signal BOOST is not limited to this.

For example, the second gamma control signal can be a second selection signal BST used to select whether a 191st gray-scale gamma voltage V191 is generated in the normal mode or the boost mode. However, the second gamma control signal BST is not limited to this.

For example, the third gamma control signal can be a voltage boost control signal used to adjust a voltage boost width of the maximum reference voltage, but it is not limited to this.

The first and second gamma control signals BOOST and BST can depend on the gamma control mode which is set by the mode establisher 103. However, the first and second gamma control signals are not limited to this.

In other words, the first and second gamma control signals BOOST and BST can be varied along the gamma control mode which is set by the mode establisher 103. For example, when the gamma control mode corresponds to the normal mode, the first and second gamma control signals BOOST and BST can have a logical value of '00', but they are not limited to this. When the gamma control mode corresponds to the boost mode, the first and second gamma control signals BOOST and BST can have another logical value of '01', but they are not limited to this.

The gamma controller 105 can select one of addresses of the second register 109 on the basis of the light quantity which is detected by the light quantity detector 109. Also, the gamma controller 105 can read the third gamma control signal from the selected address of the second register 109.

The second register 109 can be defined into first through ninth addresses, as shown in FIG. 7. However, the second register 109 is not limited to this.

The light quantities and the third gamma control signals can be stored in the addresses of the second register 109.

The second register 109 can include a mode ID (Identification) OFF used to represent the normal mode and first through eighth level page IDs Level1 through Level8 used to represent the boost mode.

As an example, the light quantity of '20' and the third gamma control signal BOOST of '00000000' can be stored in the first address of the second register 109. As another example, the light quantity of '60' and the third gamma control signal BOOST of '00010100' can be stored in the fifth address of the second register 109.

The light quantity in each of the address can be a high boundary value. As such, if the light quantity corresponds to a range of 0~20, the first address can be selected. When the light quantity corresponds to another range of 21~30, the second address can be selected.

The boost mode is defined into the first through eighth pages LEVEL1 through LEVEL8 as shown in FIG. 7. This is only an example. As such, the embodiment of the invention is not limited to this.

As seen from FIG. 7, the first level page LEVEL1 can be set to have a decimal value of '5', and the other level pages LEVEL2 through LEVEL8 can be set to have decimal values increasing from the first level page value by a decimal value of '5'. This is only an example. As such, the embodiment of the invention is not limited to this.

For example, if the light quantity no more than 20 is detected by the light quantity detector 101, the gamma voltages of the normal mode can be originally used without any adjustment, even though the mode establisher 103 sets the boost mode according to the user's demand. However, the embodiment of the invention is not limited to this.

The gamma controller 105 can refer to the second register 109 on the basis of the detected light quantity, which is applied from the light quantity detector 101, and read the third gamma control signal BOOST corresponding to the detected light quantity. The read third gamma control signal BOOST can be applied from the gamma controller 105 to the gamma voltage generation unit 30.

Figure 4:
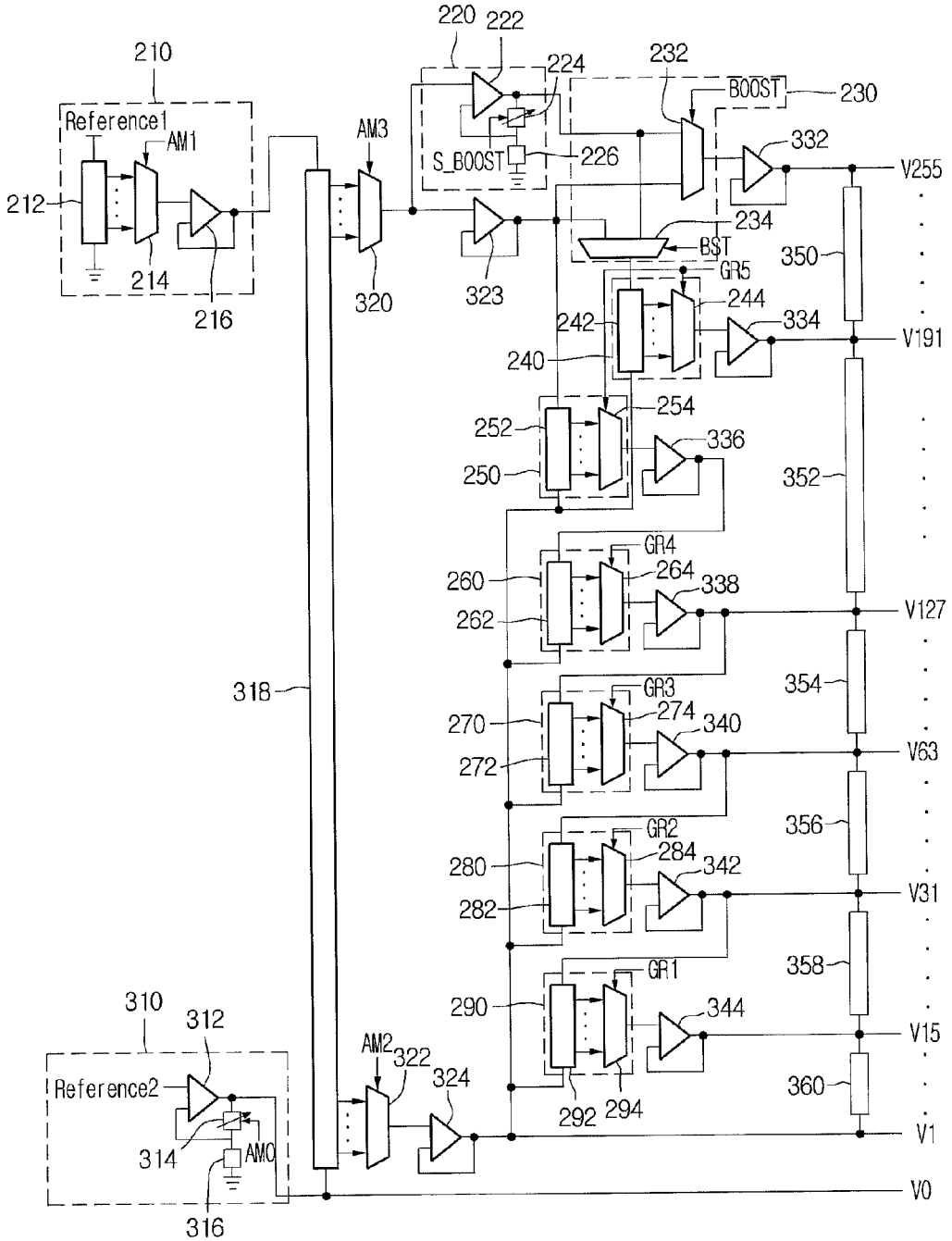
FIG. 4 is a circuit diagram showing a gamma voltage generation unit of FIG. 1 according to an embodiment of the invention.

FIG. 4 is a circuit diagram showing a gamma voltage generation unit of FIG. 1.

A maximum reference voltage booster 220, a mode selector 230 and a plurality of gamma voltage adjuster 240, 250, 260, 270, 280 and 290. The gamma voltage generation unit 30 can further include a maximum reference voltage establisher 210 and a minimum reference voltage establisher 310.

The maximum reference voltage establisher 210 can serve a function of adjusting the maximum reference voltage. The adjustment of the gamma voltages in accordance with the first example can be realized by directly adjusting the maximum reference voltage. In this instance, the gamma voltages opposite to the entire range including the gray levels 0~255 can be adjusted. For example, the gamma voltages can include a 0th gamma voltage V0, a 1st gamma voltage V1, 15th gamma voltage V15, 31st gamma voltage V31, 63rd gamma voltage V63, 127th gamma voltage V127, 191st gamma voltage V191 and 255th gamma voltage, as examples. However, the embodiment of the invention is not limited to this.

The maximum reference voltage establisher 210 can include a resistor string 212, a multiplexer 214 and a buffer 216. The resistor string 212 can serve a function of voltage-dividing a first maximum reference voltage Reference1 into at least one second maximum reference voltage, or a plurality of second maximum reference voltages. The multiplexer 214 can select one among the plurality of second maximum reference voltages using a first maximum reference voltage selection signal AM1. Also, the multiplexer 214 can output the selected significant reference voltage. The buffer 216 can serve a function of blocking a current, which flows from its output terminal towards the multiplexer 214, and stably maintains the output signal of the multiplexer 214, i.e., the selected second maximum reference voltage. However, the buffer 216 is not limited to this.

Resistor strings 242, 252, 262, 272, 282, 292, 318, 350, 352, 354, 356, 358 and 360 shown in FIG. 4 perform substantially the same function as the above-mentioned resistor string 212. As such, the description regarding the resistor strings 242, 252, 262, 272, 282, 292, 318, 350, 352, 354, 356, 358 and 360 will be omitted.

Multiplexers 232, 234, 244, 254, 264, 274, 284, 294, 320 and 322 shown in FIG. 4 perform substantially the same function as the above-mentioned multiplexer 214. As such, the description regarding the multiplexers 232, 234, 244, 254, 264, 274, 284, 294, 320 and 322 will be omitted.

Buffers 222, 312, 323, 324, 332, 334, 336, 338, 340 and 342 shown in FIG. 4 perform substantially the same function as the above-mentioned buffer 216. As such, the description regarding the buffers 222, 312, 323, 324, 332, 334, 336, 338, 340 and 342 will be omitted.

However, the multiplexer 320 can select one maximum reference voltage among a plurality of maximum reference voltages, which are applied from the resistor string 318, using a third maximum reference voltage selection signal AM3. Also, the multiplexer 320 can output the selected maximum reference voltage.

Meanwhile, the multiplexer 322 can select one minimum reference voltage among a plurality of minimum reference voltages, which are applied from the resistor string 318, using a second minimum reference voltage selection signal AM2. Also, the multiplexer 322 can output the selected minimum reference voltage.

The minimum reference voltage establisher 310 can include the buffer 312, a resistor adjuster 314 and a reference resistor 316.

A first minimum reference voltage Reference2 can be input to an input terminal of the buffer 312.

The resistor adjuster 314 and the reference resistor 316 can be serially connected to an output terminal of the buffer 312. A node between the resistor adjuster 314 and the reference resistor 316 can be connected to another input terminal of the buffer 312.

The reference resistor 316 can have a fixed resistance value. The resistance value of the resistor adjuster 314 can be varied.

As such, the output value of the buffer 312 can be one of the plurality of second minimum reference voltage varied from the first minimum reference voltage Reference2 according to a resistance value of adjusted by the resistor adjuster 314.

The resistance value of the resistor adjuster 314 can be adjusted by a first minimum reference voltage selection signal AM1, but it is not limited to this.

The first and second minimum reference voltage selection signals AM0 and AM2 and the first and second maximum reference voltage selection signals AM1 and AM3 can be generated in the control unit 10. However, the embodiment of the invention is not limited to this.

Also, gamma voltage control signals GR1, GR2, GR3, GR4 and GR5 applied to the multiplexers 244, 254, 264, 274, 284 and 294 of the gamma voltage adjusters 240, 250, 260, 270, 280 and 290 can be generated in the control unit 10. However, the embodiment of the invention is not limited to this.

The gamma voltage adjusters 250, 260, 270, 280 and 290 can be connected to one another in a cascade, but they are not limited to this. In detail, the output terminals of the preceding gamma voltage adjusters 250, 260, 270 and 280 can be connected to the input terminals of the following gamma voltage adjusters 260, 270, 280 and 290. As such, the output signals of the following gamma voltage adjusters 250, 260, 270, 280 and 290 can be derived from the output signals of the preceding gamma voltage adjusters 250, 260, 270 and 280.

The gamma voltage adjuster 240 can generate the 191st gray-scale gamma voltage V191 using the maximum reference voltage, which is applied from the maximum reference voltage booster 220 as a reference voltage, but it is not limited to this.

The maximum reference voltage booster 220 can include the buffer 222, a resistor adjuster 224 and a reference resistor 226.

Figure 5:
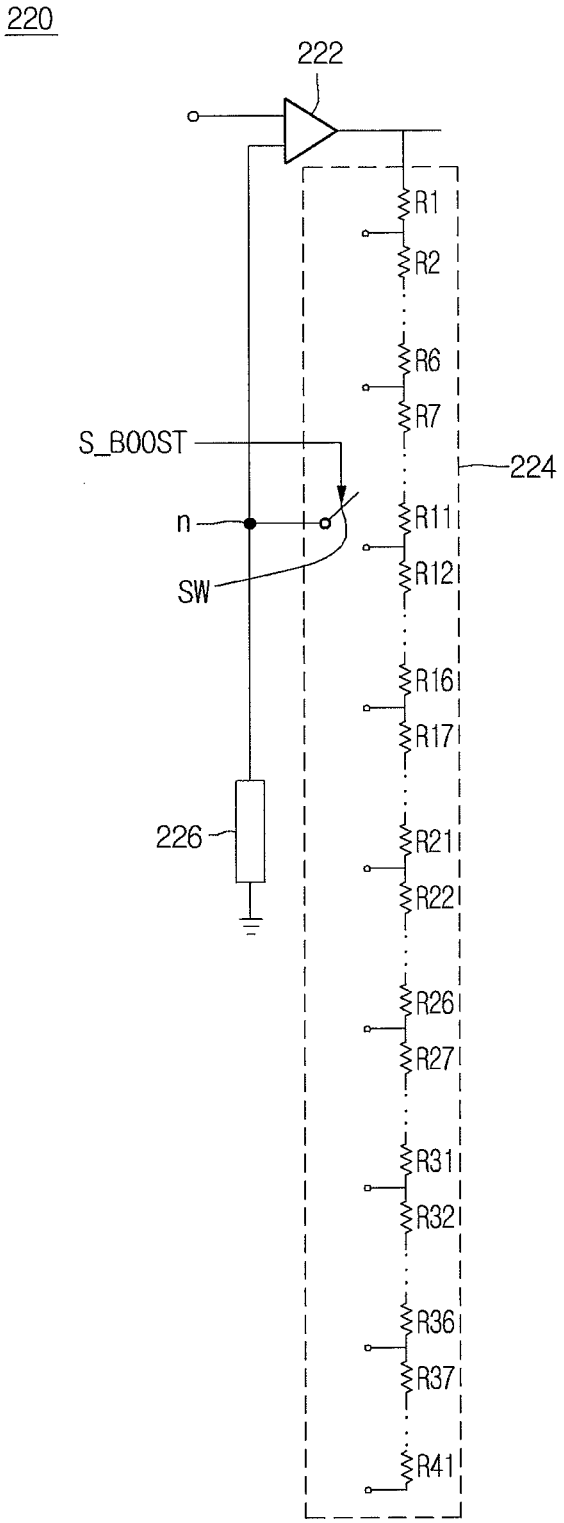
FIG. 5 is a detailed circuit diagram showing a maximum reference voltage booster according to an embodiment of the invention.

FIG. 5 is a detailed circuit diagram showing a maximum reference voltage booster.

Referring to FIG. 5, the resistor adjuster can include a resistor string and a selection switch SW. The resistor string can include 1st through 41st resistors R1 through R41 configured to serially connect an output terminal of the buffer 222. The selection switch SW can be connected to a node "n" and used to select one resistor among the 1st through 41st resistors R1 through R41. The node "n" can be connected to the selection switch SW, the reference resistor 226 and an input terminal of the buffer 222.

The selection switch SW can be switched by the third gamma control signal S_BOOST applied from the gamma controller 105 of the gamma control module 12.

For example, if the third gamma control signal S_BOOST has a logical value of '00010100', the 20th resistor R20 can be selected. In this instance, the third gamma control signal S_BOOST of '000101000' enables the switch SW to be connected to a connection terminal between the 21st resistor R21 and the 22nd resistor R22. As such, the resistance value of the resistor adjuster 224 can become a sum of resistance values of the 1st through 21st resistors R1 through R21.

As another example, the 1st resistor R1 can be selected when the third gamma control signal S_BOOST has a logic value of '000000000'. In this instance, the switch SW can be connected to another connection terminal between the 1st resistor R1 and the 2nd resistor R2. As such, the resistance value of the resistor adjuster 224 can become the resistance value of the 1st resistor R1.

The mode selector 230 can select whether the 255th gamma voltage V255 of a gray level 255 and the 191st gamma voltage of a gray level 191 are generated in one of the normal mode and the boost mode.

The mode selector 230 can include a first multiplexer 233 and a second multiplexer 234. The first multiplexer 232 can select whether the 255th gray-scale gamma voltage is generated in any one of the normal mode and the boost mode. The second multiplexer 234 can select whether a reference voltage used to generate the 191st gray-scale gamma voltage V191 is generated in any one of the normal mode and the boost mode.

Although it is disclosed that the mode selector 230 includes the first and second multiplexers 232 and 234, but the embodiment of the invention is not limited to this. In other words, every selection element capable of selecting one of two signals can be used in the mode selector 230.

The first multiplexer 232 can be controlled by the first gamma control signal BOOST. The second multiplexer 234 can be controlled by the second gamma control signal BST.

For example, if the first gamma control signal BOOST has a logic value of '00', the first multiplexer 232 can select the maximum reference voltage of the normal mode, which is applied from the buffer 323. When the first gamma control signal has another logic value of '01', the first multiplexer 232 can select the maximum reference voltage of the boost mode which is boosted in the maximum reference voltage booster 220.

Likewise, the second multiplexer 234 can perform the above-mentioned selection operation by the second gamma control signal BST. However, the embodiment of the invention is not limited to this.

Although it is disclosed that the first and second multiplexers 232 and 234 are independently controlled by the first gamma control signal BOOST and the second gamma control signal BST, the embodiment of the invention is not limited to this. In other words, the first and second multiplexers 232 and 234 can be controlled by a single gamma control signal.

If the maximum reference voltage of the boost mode is selected by the first and second multiplexers 232 and 234, the 191st gray-scale gamma voltage V191 and the 255th gray-scale gamma voltage V255 of the boost mode can be boosted in higher voltages compared to those of the normal mode.

If the 191st gray-scale gamma voltage V191 and the 255th gray-scale gamma voltage V255 are boosted, gray-scale gamma voltages between the 191st and the 255th gray-scale gamma voltages V191 and V255 as well as gray-scale gamma voltages between a 127th gray-scale gamma voltage V127 and the 191st gray-scale gamma voltage V191 can be also boosted.

Figure 9:
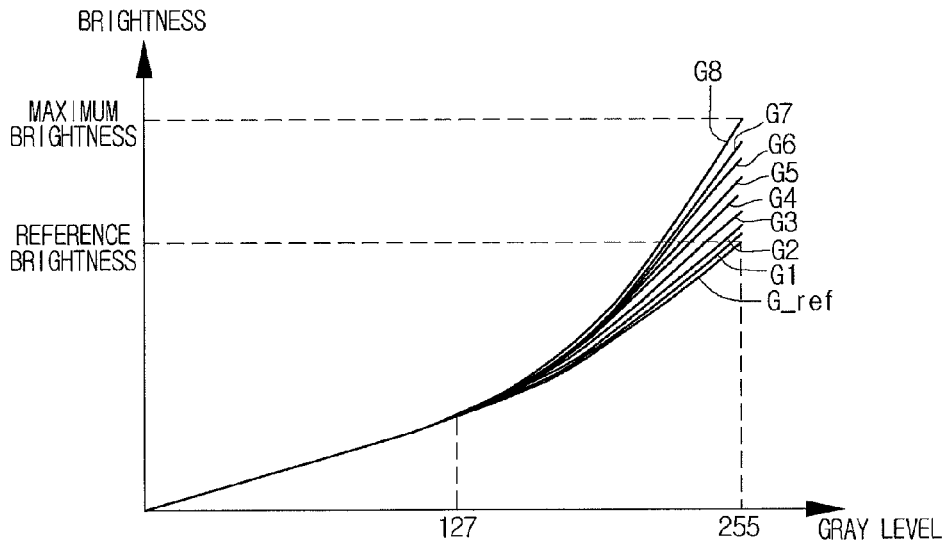
FIG. 9 is a graph illustrating gamma characteristic curves in accordance with a maximum reference voltage which is boosted by the maximum reference voltage booster of FIG. 4 according to an embodiment of the invention.

In other words, a normal gamma characteristic curve G_ref having a reference brightness at the 255ths gray-scale gamma voltage can be obtained by the gamma voltage generation unit 30 in the normal mode, as shown in FIG. 9.

Moreover, in the boost mode, one of eight gamma characteristic curves having a higher brightness than the reference brightness at the 255th gray-scale gamma voltage V255 as one of the first through eighth levels Level1~Level8 shown in FIG. 7 is selected.

For example, the first through eighth gamma characteristic curves can be selectively obtained according to the light quantity, which is sensed by an illumination sensor and detected by the light quantity detector 101, even though the boost mode is selected.

The embodiment of the invention can allow only gamma voltages opposite to gray levels of no lower than a gray level 127 to be adjusted. In this instance, brightness opposite to a lower gray level can be originally maintained. As such, a contrast ratio can be enhanced.

Also, the embodiment of the invention adjusts the gamma voltages instead of modulating the data. As such, data loss and image distortion can be prevented or reduced.

Moreover, the embodiment of the invention can be implemented by partially the circuit without additionally requiring many components. Therefore, the circuit configuration can be simplified.

In the embodiment of the invention the 0th gray-scale gamma voltage V0, 1st gray-scale gamma voltage V1, 15th gray-scale gamma voltage V15, 31st gray-scale gamma voltage V31, 63rd gray-scale gamma voltage V63, 127th gray-scale gamma voltage V127, 191st gray-scale gamma voltage V191 and 255th gray-scale gamma voltage V255 are defined. However, the embodiment of the invention is not limited to this. In other words, gray-scale gamma voltages being less or more than the above-mentioned gray-scale gamma voltages V0, V1, V15, V31, V63, V127, V191 and V255 can be defined or used.

Figure 10:
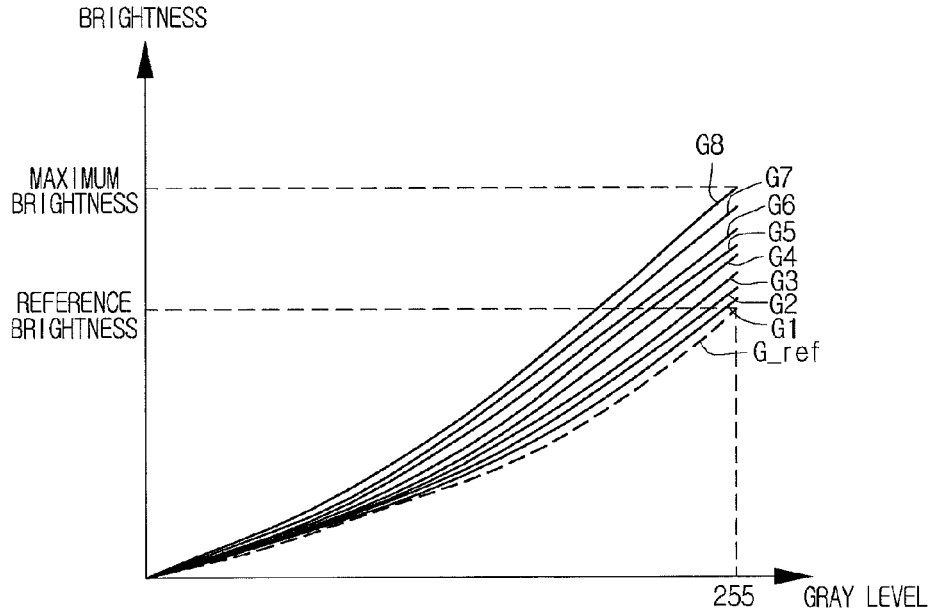
FIG. 10 is a graph illustrating gamma characteristic curves in accordance with a maximum reference voltage which is varied by the maximum reference voltage establisher of FIG. 4 according to an embodiment of the invention.

Meanwhile, the gamma voltages in the entire range and not a partial range can be adjusted as shown in FIG. 10. This had been already briefly described in the first example.

As shown in FIG. 4, the first and second multiplexers 232 and 234 included in the mode selector 230 can perform the operation of selecting the maximum reference voltage of the normal mode.

The first maximum reference voltage Reference1 can be voltage-divided into the plurality of first maximum reference voltages by the resistor string 212 which is included in the maximum reference voltage establisher 210. One of the first maximum reference voltages can be selected by the multiplexer 214. In this instance, the first maximum reference voltage selected by the multiplexer 214 can be output via the mode selector 230 as a 255th gray-scale gamma voltage. Also, the first maximum gamma voltage selected by the multiplexer 214 can be used to generate the remaining gray-scale gamma voltages V191, V127, V63, V31 and V15.

The first maximum reference voltage Reference1 can be a voltage providing maximum brightness in an eighth gamma characteristic curve G8 shown in FIG. 10. In this instance, voltages each providing brightnesses of 255th gray levels V255 in first through seventh gamma characteristic curves G1 through G7, which are shown in FIG. 10, can be lower than the first maximum reference voltage Reference1, but they are not limited to this.

The maximum reference voltage establisher 210 can be configured with the components of the minimum reference voltage establisher 310. In this instance, the maximum reference voltage establisher 210 can adjust the maximum gamma voltage providing the gamma characteristic curves shown in FIG. 10. In other words, the maximum reference voltage establisher 210 can include a buffer, a resistor adjuster and a reference resistor. In this configuration of the maximum reference voltage establisher 210, the resistor adjuster can selectively generate the first maximum reference voltage of the normal mode and the first maximum reference voltages of first through eighth level pages of the boost mode.

Meanwhile, when the automatic mode is set by the gamma control module 12, the light quantity data stored in the third register 111 can be used to determine whether the gamma voltage generation unit 30 is driven in one of the normal mode and the boost mode, more specifically in one of the normal mode and the level pages of the boost mode. As such, brightness can be automatically controlled.

The third register 111 can store 32-bit light quantity data as shown in FIG. 8, but it is not limited to this. Alternatively, the detected light quantity data obtained by the light quantity detector 101 can be stored in the third register 111. In other words, the detected light quantity data can be used to update the third register 111.

The automatic mode is not set by the mode selection of a user. However, the automatic mode can be realized by which the gamma control module 12 determines itself the control mode and controls the gamma voltage generation unit 30 according to the determined control mode. However, the embodiment of the invention is not limited to this.

For example, if the detected light quantity is no more than 20, the gamma control module 12 can determine the normal mode on the basis of the data which is shown in FIG. 7 and stored in the second register 109. The gamma control module 12 can generate the first through third gamma control signals in accordance with the normal mode. The first through third gamma control signals generated in the gamma control module 12 can be applied to the gamma voltage generation unit 30. The gamma voltage generation unit 30 can generate the gray-scale gamma voltages of the normal mode in response to the first through third gamma control signals.

As another example, when the detected light quantity corresponds to '72', the gamma control module 12 can determine the boost mode (more specifically, the sixth level page of the boost mode) on the basis of the data which is stored in the second register 109. The gamma control module 12 can generate the first through third gamma control signals in accordance with the sixth level page of the boost mode. The first through third gamma control signals generated in the gamma control module 12 can be applied to the gamma voltage generation unit 30. The gamma voltage generation unit 30 can generate the gray-scale gamma voltages in accordance with the sixth level page of the normal mode in response to the first through third gamma control signals.

Although embodiments have been described with reference to a number of illustrative embodiments thereof, it should be understood that numerous other modifications and embodiments can be devised by those skilled in the art that will fall within the spirit and scope of the principles of the invention. More particularly, various variations and modifications are possible in the component parts and/or arrangements of the subject combination arrangement within the scope of the invention, the drawings and the appended claims. In addition to variations and modifications in the component parts and/or arrangements, alternative uses will also be apparent to those skilled in the art.

What is claimed is:

1. A gamma voltage generation unit, comprising:

a voltage booster configured to boost a first reference voltage into a second reference voltage, wherein the first reference voltage is a reference voltage for a normal mode and the second reference voltage is a reference voltage for a boost mode;

a mode selector configured to select one of the first reference voltage and the second reference voltage, wherein the selected first or second reference voltage is output as a first gray-scale gamma voltage; and a plurality of gamma voltage adjusters configured to generate a plurality of gray-scale gamma voltages except for the first gray-scale gamma voltage, wherein the plurality of gamma voltage adjusters include a first gamma voltage adjuster and remaining gamma voltage adjusters, wherein the first gamma voltage adjuster is configured to adjust the selected first or second reference voltage to generate a second gray-scale gamma voltage among the plurality of gray-scale gamma voltages, wherein among the remaining gamma voltage adjusters, an output terminal of a preceding gamma voltage adjuster is connected to an input terminal of a following gamma voltage adjuster and generates remaining gray-scale gamma voltages except for the first and second gray-scale gamma voltages, the remaining gray-scale gamma voltages of following gamma voltage adjusters being output based on gray-scale gamma voltages output from preceding gamma voltage adjusters, wherein when driven in the boost mode, respective gamma voltages corresponding to a specific gray level through a gray level 255 among a gray level 0 through a gray level 255 are boosted higher to have higher brightness and respective gamma voltages corresponding to a gray level 0 through the specific gray level are not changed, and wherein a plurality of gamma characteristic curve with respect to a range of the specific gray level through the gray level 255 are differently generated according to different boost voltage increases, and one of the plurality of gamma characteristic curve is selected based on light quantity in the boost mode.

2. The gamma voltage generation unit of claim 1, wherein the voltage booster includes:

a buffer responsive to the first reference voltage; and a resistor adjuster string-serially connected to an output terminal of the buffer for adjusting a resistance to boost the first reference voltage into the second reference voltage.

3. The gamma voltage generation unit of claim 1, wherein the mode selector includes:

a first selector configured to select one of the first reference voltage and the second reference voltage and provide the selected first or second reference voltage as the first gray-scale gamma voltage; and a second selector configured to select one of the first reference voltage and second reference voltage and supply the selected first or second reference voltage to the first gamma voltage adjuster.

4. The gamma voltage generation unit of claim 3, wherein the first gamma voltage adjuster is configured to generate the second gray-scale gamma voltage using the selected first or second reference voltage which is output from the second selector.

5. The gamma voltage generation unit of claim 3, wherein each of the first and second selectors is a multiplexer.

6. The gamma voltage generation unit of claim 3, wherein the first and second selectors are controlled by control signals different from each other.

7. The gamma voltage generation unit of claim 3, wherein the first and second selectors are controlled by the same control signal.

8. The gamma voltage generation unit of claim 1, further comprising an establisher connected to an input terminal of the voltage booster and configured to adjust the first reference voltage.

9. The gamma voltage generation unit of claim 8, wherein the establisher is configured to divide a third reference voltage into a plurality of fourth reference voltages and select one among the plurality of fourth reference voltages as the first reference voltage.

10. The gamma voltage generation unit of claim 1, wherein the second reference voltage is differently boosted using the first reference voltage according to the different boost voltage increases.

11. The gamma voltage generation unit of claim 1, wherein the first gray-scale voltage is a $255^{th}$ gray-scale gamma voltage, and wherein the second gray-scale gamma voltage is a $191^{st}$ gray-scale gamma voltage.

12. A display device comprising:

a light quantity detector configured to detect a light quantity;

a gamma controller configured to generate a selection control signal and a boost control signal according to the detected light quantity; and a gamma voltage generation unit configured to adjust gamma voltages based on the selection control signal and the boost control signal, wherein the gamma voltage generation unit includes:

a voltage booster configured to boost a first reference voltage into a second reference voltage based on the boost control signal, wherein the first reference voltage is a reference voltage for a normal mode and the second reference voltage is a reference voltage for a boost mode;

a mode selector configured to select one of the first reference voltage and the second reference voltage based on the selection control signal, wherein the selected first or second reference voltage is output as a first gray-scale gamma voltage; and a plurality of gamma voltage adjusters configured to generate a plurality of gray-scale gamma voltages except for the first gray-scale gamma voltage, wherein the plurality of gamma voltage adjusters includes a first gamma voltage adjuster and remaining gamma voltage adjusters, wherein the first gamma voltage adjuster is configured to adjust the selected first or second reference voltage to generate a second gray-scale gamma voltage among the plurality of gray-scale gamma voltages, wherein among the remaining gamma voltage adjusters, an output terminal of a preceding gamma voltage adjuster is connected to an input terminal of a following gamma voltage adjuster and generates remaining gray-scale gamma voltages except for the first and second gray-scale gamma voltages, the remaining gray-scale gamma voltages of following gamma voltage adjusters are output based on gray-scale gamma voltages output from preceding gamma voltage adjusters, wherein when driven in the boost mode, respective gamma voltages corresponding to a specific gray level through a gray level 255 among a gray level 0 through a gray level 255 are boosted higher to have higher brightness and respective gamma voltages corresponding to a gray level 0 through the specific gray level are not changed, and wherein a plurality of gamma characteristic curve with respect to a range of the specific gray level through the gray level 255 are differently generated according to different boost voltage increases, and one of the plurality of gamma characteristic curve is selected based on the light quantity in the boost mode.

13. The display device of claim 12, further comprising;

a mode establisher configured to set a control mode corresponding to a command of a user; and a register in which information on one of the selection control signal and the boost control signal is stored.

14. The display device of claim 12, wherein a boost voltage increase from the first reference voltage to the second reference voltage is determined based on the boost control signal.

15. The display device of claim 12, wherein the second reference voltage is differently boosted using the first reference voltage according to the different boost voltage increases.

16. The display device of claim 12, wherein the first gray-scale voltage is a $255^{th}$ gray-scale gamma voltage, and wherein the second gray-scale gamma voltage is a $191^{st}$ gray-scale gamma voltage.

* * * * *